US006775875B2

(12) United States Patent
Ornelas et al.

(10) Patent No.: US 6,775,875 B2
(45) Date of Patent: Aug. 17, 2004

(54) DENTAL CARE INSTRUMENT WITH PIVOTING TRACK FOR DETACHABLE BRISTLE BED

(75) Inventors: Charles Ornelas, New York, NY (US); Paul Sava, Jr., Yonkers, NY (US)

(73) Assignee: Paul A. Sava, Yonkers, NY (US)

( * ) Notice: Subject to any disclaimer, the term of this patent is extended or adjusted under 35 U.S.C. 154(b) by 163 days.

(21) Appl. No.: 10/188,142

(22) Filed: Jul. 2, 2002

(65) Prior Publication Data

US 2004/0003479 A1 Jan. 8, 2004

(51) Int. Cl.[7] ..... A46B 9/04
(52) U.S. Cl. ..... 15/176.1; 15/167.1; 15/176.6
(58) Field of Search ..... 15/176.1, 176.6, 15/172, 167.1, 202, 22.1, 22.2

(56) References Cited

U.S. PATENT DOCUMENTS

| | | | | |
|---|---|---|---|---|
| 1,092,014 A | | 3/1914 | Briggs | |
| 1,329,980 A | | 2/1920 | Laudiero | |
| 1,407,214 A | | 2/1922 | Osborn | |
| 1,497,495 A | | 6/1924 | Fincke | |
| 1,571,999 A | | 2/1926 | Davis | |
| 1,702,042 A | | 2/1929 | Doskow | |
| 1,719,426 A | | 7/1929 | Gade | |
| 1,750,500 A | | 3/1930 | Weisz | |
| 1,835,319 A | * | 12/1931 | Myers | 15/172 |
| 1,853,854 A | | 4/1932 | Frank | |
| 1,901,139 A | | 3/1933 | Barton | |
| 2,326,632 A | | 8/1943 | Friedman | 15/176 |
| 2,618,003 A | | 11/1952 | Robey | 15/176 |
| 2,638,614 A | | 5/1953 | Anderson | 15/138 |
| 2,668,973 A | | 2/1954 | Glaza et al. | 15/176 |
| 2,675,573 A | | 4/1954 | Strong | 15/176 |
| 2,677,842 A | * | 5/1954 | Sherwin | 15/210.1 |
| 2,893,031 A | | 7/1959 | Dengler | 15/123 |
| 4,370,773 A | | 2/1983 | Hadary | 15/172 |
| 4,928,343 A | | 5/1990 | Kissinger | 15/209 D |
| 5,005,246 A | | 4/1991 | Yen-Hui | 15/111 |
| 5,224,234 A | | 7/1993 | Arsenault et al. | 15/167.1 |
| 5,412,831 A | | 5/1995 | Mongelluzzo | 15/167.1 |
| 5,511,276 A | | 4/1996 | Lee | 15/167.1 |
| 5,673,453 A | | 10/1997 | Huang | 15/167.1 |
| 5,737,792 A | | 4/1998 | Quigless | 15/167.1 |
| 6,029,307 A | | 2/2000 | Baudoin | 15/145 |
| 6,079,075 A | | 6/2000 | Velez-Juan | 15/167.1 |
| 6,145,152 A | | 11/2000 | Ward | 15/176.1 |
| 6,145,153 A | | 11/2000 | Weihrauch | 15/176.4 |
| 6,237,183 B1 | | 5/2001 | Fischer | 15/167.1 |

* cited by examiner

*Primary Examiner*—Robert J. Warden, Sr.
*Assistant Examiner*—Laura C Cole

(57) ABSTRACT

A visually appealing toothbrush having an applicator portion including a head and a track and including a replaceable bristle bed, wherein the track on which a bristle bed is slidingly mounted is rotatable out of a longitudinal axis of the handle into an open position by the rotation of a knob at the end of the handle, the open position allowing disengagement and replacement of the bristle bed, the track then being rotatable back into the longitudinal axis of the handle in order to trap and lock a newly mounted bristle bed by means of a stop at an extremity of the head.

20 Claims, 4 Drawing Sheets

DENTAL CARE INSTRUMENT WITH PIVOTING TRACK FOR DETACHABLE BRISTLE BED

FIELD OF THE INVENTION

The field of this invention is personal hygiene. More particularly, the field of this invention is toothbrushes, and especially those with disposable or replaceable parts.

BACKGROUND OF THE INVENTION AND DISCUSSION OF THE PRIOR ART

The humble tooth brush has long been a target of inventive art. In particular, it has long been recognized that the bristle or brush section generally wears down faster than the handle, rendering the brush unusable, and generally requiring the brush's complete disposal and replacement. Numerous methods have thereby been proposed which allow the toothbrush head or bristle portion to be replaced while reusing the handle.

Today, however, an examination of the products available in any drugstore will reveal that with the exception of expensive motorized toothbrushes, the disposable head concept has not been a commercial success. The reason for this lack of success is not hard to divine: the minor expense of a new molded plastic or rubber handle with integral bristles removes the economic incentive to provide a more expensive reusable handle. Despite the apparent waste of material, economics still favors disposal of the simple, single-piece toothbrush.

Also, a toothbrush handle having been in service long enough to wear down the bristles, though itself not actually substantially worn, may appear to be in used condition through hard water or dried toothpaste deposits. These deposits form even with regular rinsing, and so create an additional incentive to throw away the entire inexpensive brush assembly away rather than clean the handle. The user enjoys the "inconspicuous consumption" of a new toothbrush.

There may be a reason other than economics to provide a method of replacing of the brush head, and at more frequent intervals than required by the wear of the bristles: hygiene. Studies have shown that a toothbrush in daily use harbors both minute food particles and bacteria. For this reason a user may want to replace the bristles more frequently than dictated by wear. A consumer may also occasionally want to allow a person whom he does not wish to risk cross-contamination with to borrow his toothbrush.

Consumers who wish to replace the bristles at high frequency may find the expense of using a fresh single piece toothbrush each time to be unacceptable. Therefore, while simple economics may not support the concept of reusing a handle when the bristles have been worn and require replacement, there may be demand for such a product for more frequent bristle exchanges, analogous to the provision of a fresh dinner napkin with each diner and each meal. There is no product on the market which permits convenient and economical replacement of the bristles of a toothbrush at frequent intervals.

For purposes of hygienic bristle exchange, all disposable head toothbrushes known to the inventor have one or more disadvantages. Existing art either requires the user to handle the bristle mounting structure directly, thus providing a ready source of cross-contamination and tending to defeat the purpose of hygienic interchange, or require considerable dexterity in manipulating springs and clips and other small parts to change heads, or lack a secure way of securing the disposable head to the handle, risking unintended disengagement while brushing, or share some combination of these drawbacks which would be advantageous to overcome. One early model for example slides a brush head onto a grooved sheet metal track, only secured by friction, which track might severely injure the gums of a user should the brush head come off during vigorous brushing.

It therefore would be advantageous to provide a toothbrush with replaceable bristles and supporting structure, which was simple and economical enough for frequent replacement, which minimized handling requirements for the replaceable parts, which provided a secure lock or engagement of a replaceable part to prevent unintended disengagement and overcame the other limitations of the prior art.

It would also be advantageous to provide a product having these features which was easy and enjoyable for a user to operate, and thereby encouraged frequent bristle replacement, both maximizing the hygienic advantages to be obtained from using the product, and increasing the economic advantages to the manufacturer of the device.

SUMMARY OF THE PRESENT INVENTION

A dental care instrument or toothbrush has at least two elements in a handle or grip that rotate relative to one another. The rotating elements are provided with knurled or other frictional gripping surfaces to facilitate gripping by a user and to enable the user to impart opposing rotational motion to the segments. The relatively rotating elements may be portion of the handle which the user grasps in the process of brushing the teeth and a knob mounted on an end of the handle away from the brush head, for the purpose of operating the mechanism to replace the brush head.

The handle is hollow, and contains an internal mechanical linkage. Application of opposing rotational motion to the rotating elements causes, via the internal mechanical linkage, a rotation of a U-shaped frame or track located on the opposite or head end of the instrument out of a longitudinal axis of the head, thereby allowing replacement of bristles mounted on a grooved bristle bed which slides onto and off the U-shaped track.

In this patent application, the term "brush head" is used synonymously with the term "bristle bed" and should not be confused with the head of the toothbrush, which is a section of the toothbrush in an applicator section of the toothbrush. The applicator section of the toothbrush comprises a head and a neck whereby the head is connected to the toothbrush handle. The track is adapted to engage a disposable bristle bed, such as by the track engaging a portion of the bed having grooves. When the U-shaped track is rotated out of the longitudinal axis of the head a disposable bristle bed may be readily engaged or disengaged from the track by sliding. When the track is rotated back into the axis of the head, the track and bed lock in a closed position at the end of rotational travel when the track or bristle bed engage a lip or stop located on a tip of the head, in order to prevent the bristle bed from becoming disengaged.

The arrangement of the invention prevents unintended disengagement of the bristle bed by employing a locking surface to prevent travel of the bed in a closed position of the track and not relying entirely on friction to secure the bed, unlike U.S. Pat. No. 1,092,014 to Briggs which shows no evidence of contemplating other than a simple frictional fit. Rotation of the track in Briggs is solely a means of allowing the user to select a variable angle of brush head for the user's brushing preference. The rotation of the track has nothing to do with removal of the bristles, which may be removed and replaced with the track at any angle. In the present invention rotation of the track is provided not to alter the geometry of the brush for brushing, but entirely in the service of removal and replacement of the bristles, which are locked in by the lip or stop when the track is in a first, closed, position and removable only when the track is in a second, open position.

In the unlikely event that the tracks moves off the closed position during use, the user will notice the bristle bed shifting and return the brush head to its use or service position. It is extremely unlikely that sufficient unintentional rotation of the track could occur to allow the bristle bed to become inadvertently disengaged from the track. This is partially due to internal gearing, to be described below, which prevents rotation of the track by pushing the track directly. Instead, one has to turn the knob. The combination of this gearing and a fiction fit of the bed or track with the lip is sufficient to prevent unintended movement of the brush head. However, snap fit or other locking devices may be added for additional security.

A bend or elbow is advantageously added to the toothbrush between the handle and the head, in a region called the neck, to allow a more natural brushing angle with respect to a user's mouth, but this is geometry optional to the invention.

In a process of use, starting with an empty track fully rotated out the axis of the head to an open position, a user may open a sanitary package containing an individual brush head, for example, by ripping off an end closure of that package, and the replacement head may thereby be handled by the package or bag without the user contacting the bristles, while it is slid onto the track. The user then appropriately rotates the handle sections to cause the track to rotate back into the axis of the handle and engage in a use position, wherein the brush head is blocked from sliding movement by a stop on the end of the handle. The dental care instrument is now ready for brushing.

When a user later wishes to dispose of the used brush head, he reverses the operation by twisting the rotating section of the handle in the opposite direction, rotating the track out of the axis of the handle, and allowing removal of the brush head. It is not necessary for the user to grasp the brush head to remove it, however, since it may be simply flipped off into the garbage. Thereby it is possible for the user concerned about hygiene to both load and unload the unit without contaminating either himself or the bristles; a feature which also may be of use in institutional or medical settings.

Alternatively, replacement heads may be packaged with multiple units in a single closure, analogous to double edge razor blades, and in a manner adapted to allow removal of one unit by insertion of the prongs of the U-shaped track into the package to engage a single bristle head, which is then removed from the package using the toothbrush as a handle, and then locked into place as described above, as will be apparent to those skilled in the art.

IMPORTANT OBJECTS AND ADVANTAGES

The following important objects and advantages of the present invention are:

(1) To provide a toothbrush with a replaceable bristle bed;

(2) To provide a toothbrush with a replaceable bristle bed which operates in an economical way;

(3) To provide a toothbrush with a disposable bristle bed which minimizes the need to handle the old and new bristles on the part of a user effecting a replacement;

(4) To provide a method for replacing a toothbrush bristle bed which is simple for a user to operate;

(5) To provide a method for replacing a toothbrush bristle bed which a user can operate in an hygienic way, without contacting the new or used bristles;

(6) To provide a toothbrush with a disposable bed that carries bristles which bed slidably engages a track during use; and (7) To provide a disposable bristle bed toothbrush and method of using the same which is enjoyable for a user, and encourages frequent bristle replacement.

These and other objects of the invention will become apparent from reading the attached specification.

DETAILED DESCRIPTION OF THE PREFERRED EMBODIMENT

Figures 1, 1A:
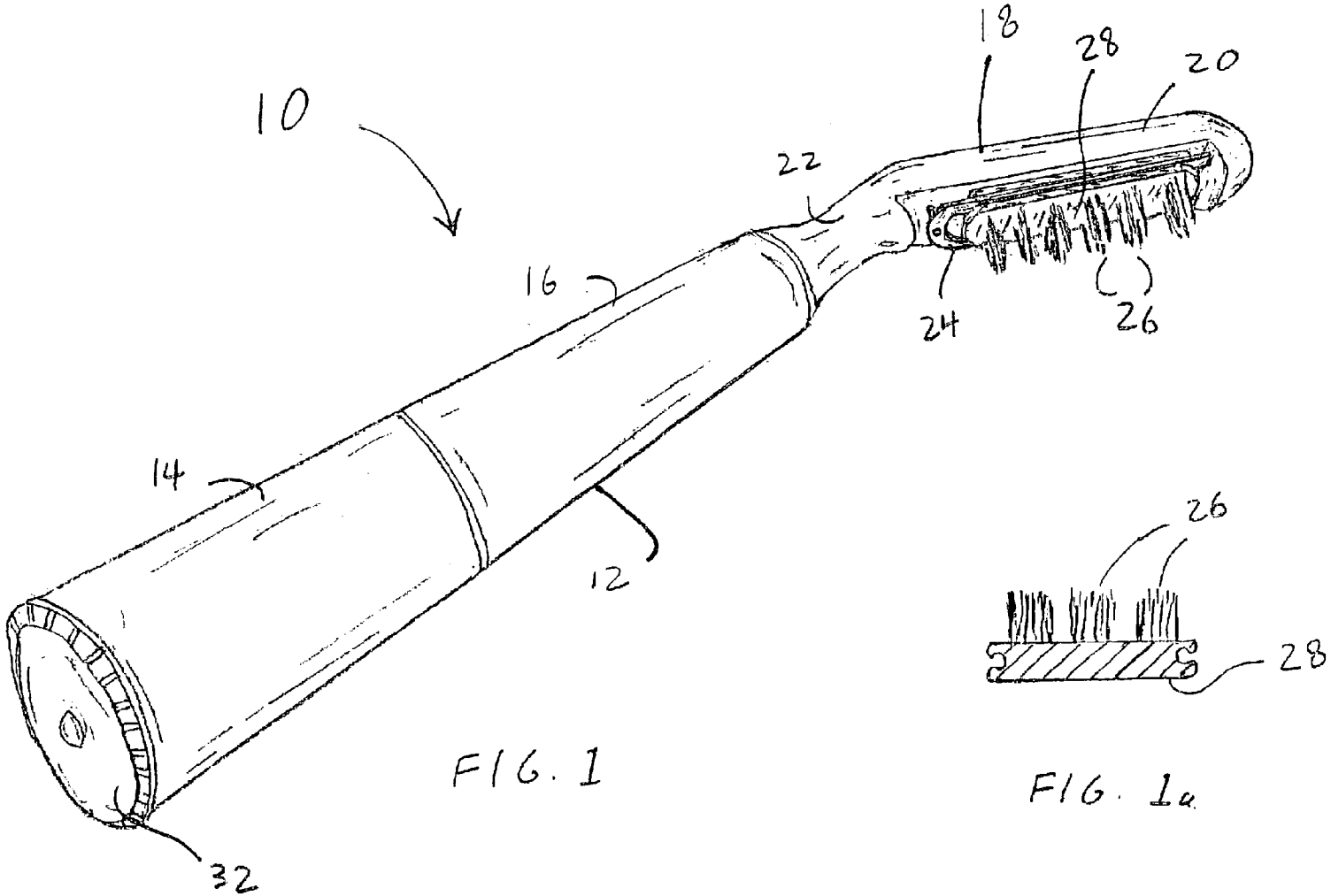
FIG. 1 is a perspective view of the toothbrush of the present invention.
FIG. 1*a* is a cross-sectional view of a disposable bristle bed, showing the recessed grooves therein which engage the track in the handle.

The apparatus of the present invention will now be illustrated by reference to the accompanying drawings. The toothbrush of the present invention has been assigned reference numeral 10 Other elements have been assigned the reference numerals referred to below.

Toothbrush 10 as generally shown in FIG. 1 comprises a hollow handle 12 with gripping portions 14, 16, an applicator section 18 including a head 20 and a neck 22, the head including a track 24 which is pivotally mounted to a lower portion of the head. The toothbrush also includes bristles 26 sitting on a bed 28 (shown in cross section in FIG. 1*a*) which is slidably engageable to track 24, and a shaft 30 (FIGS. 2 and 3) running through hollow handle 12 and neck 22 generally longitudinally, shaft 30 having a knob 32 at a first end that extends from a bottom of the handle, a second end of the shaft having gearing so that turning knob 32 in a first direction rotates the track out of a longitudinal axis of the head to an open position, and turning knob 32 in a second opposite direction of rotation rotates the track back into a longitudinal axis of the head in a closed position, as will become clear in subsequent figures. Typically, although not necessarily, the slidable engagement of the bed 28 with the track 24 is based on the bed 28 and track 24 having complementary surfaces that are mated together to slidably engage bed 28 with track 24.

In the open position bed 28 and bristles 26 can be slidably removed from track 24 and replaced with a new bed and bristles, whereas when track 24 is aligned with the longitudinal axis of the head in a second, closed, position, the bed is locked into place by a tip 44 of head 20. In order to lock bed 28 by tip 44, various embodiments known to those skilled in the art may be envisioned including a frictional fit or a snap connection wherein bed 28 (or track 24) has a rounded upper portion and tip 44 has an indented area. In addition, toothbrush 10 can be made so that tip 44 is formed of a slightly flexible material. In an alternative embodiment tip 44 can be lifted slightly in a direction away from handle 12, such as by introducing a spring or other element, in order to allow track 24 to swing outwardly to the open position.

Figure 2:
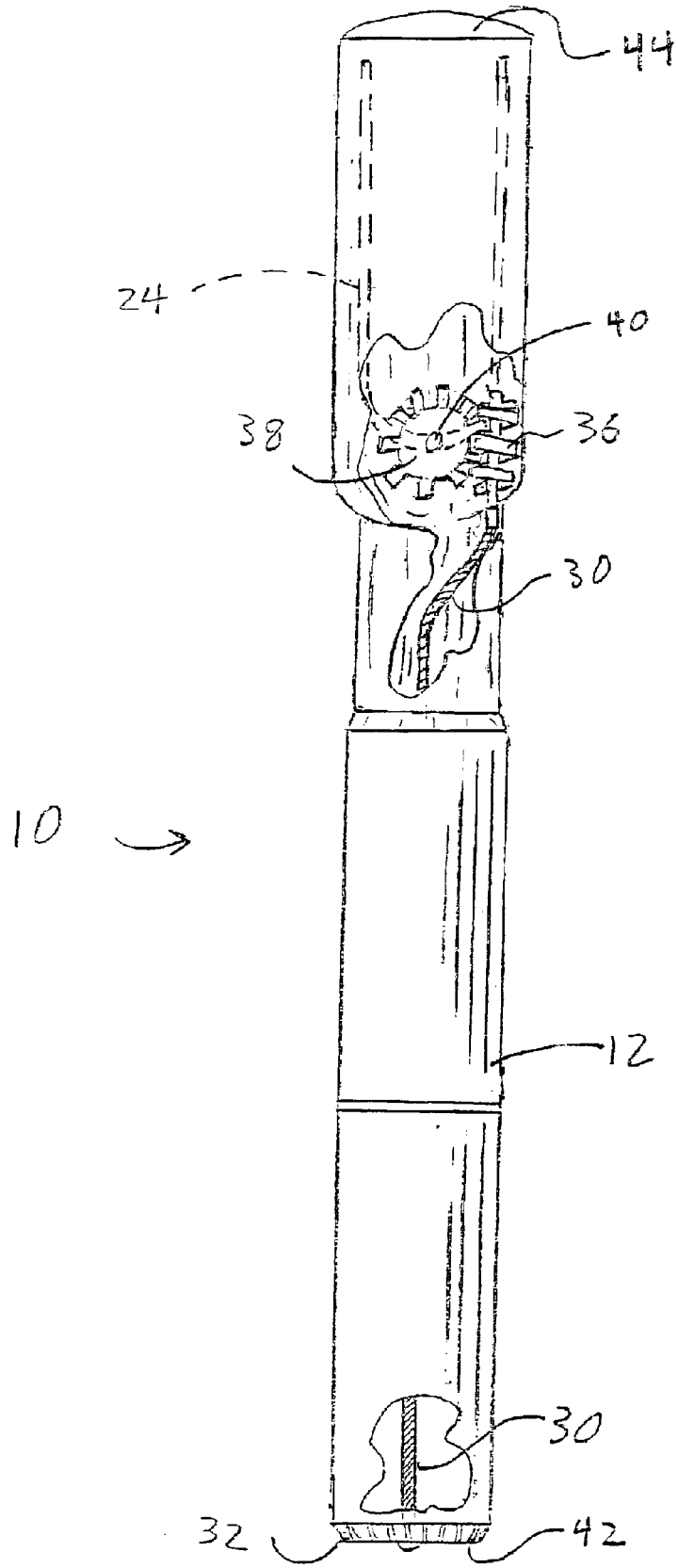
FIG. 2 is a rear elevation view of the toothbrush of the present invention, in a partial broken-away view showing internal mechanism, and with the bed and bristles removed.

In a preferred embodiment track 24 is generally U-shaped, as may be seen more clearly in FIG. 2. Also in a preferred embodiment head 20 is bent at an angle with respect to the handle 12, the bend occurring in the region of the neck 22 in order to facilitate a more comfortable brushing position for a user.

It will be recognized by those skilled in the art that many varieties of gearing can be contemplated which would convert a rotary motion of knob 32 into a second substantially perpendicular rotation of track 24. Advantageously such gearing will create a mechanical advantage between the knob and the track, which will also prevent unintentional rotation of the track by forces acting directly on the track.

Figure 3:
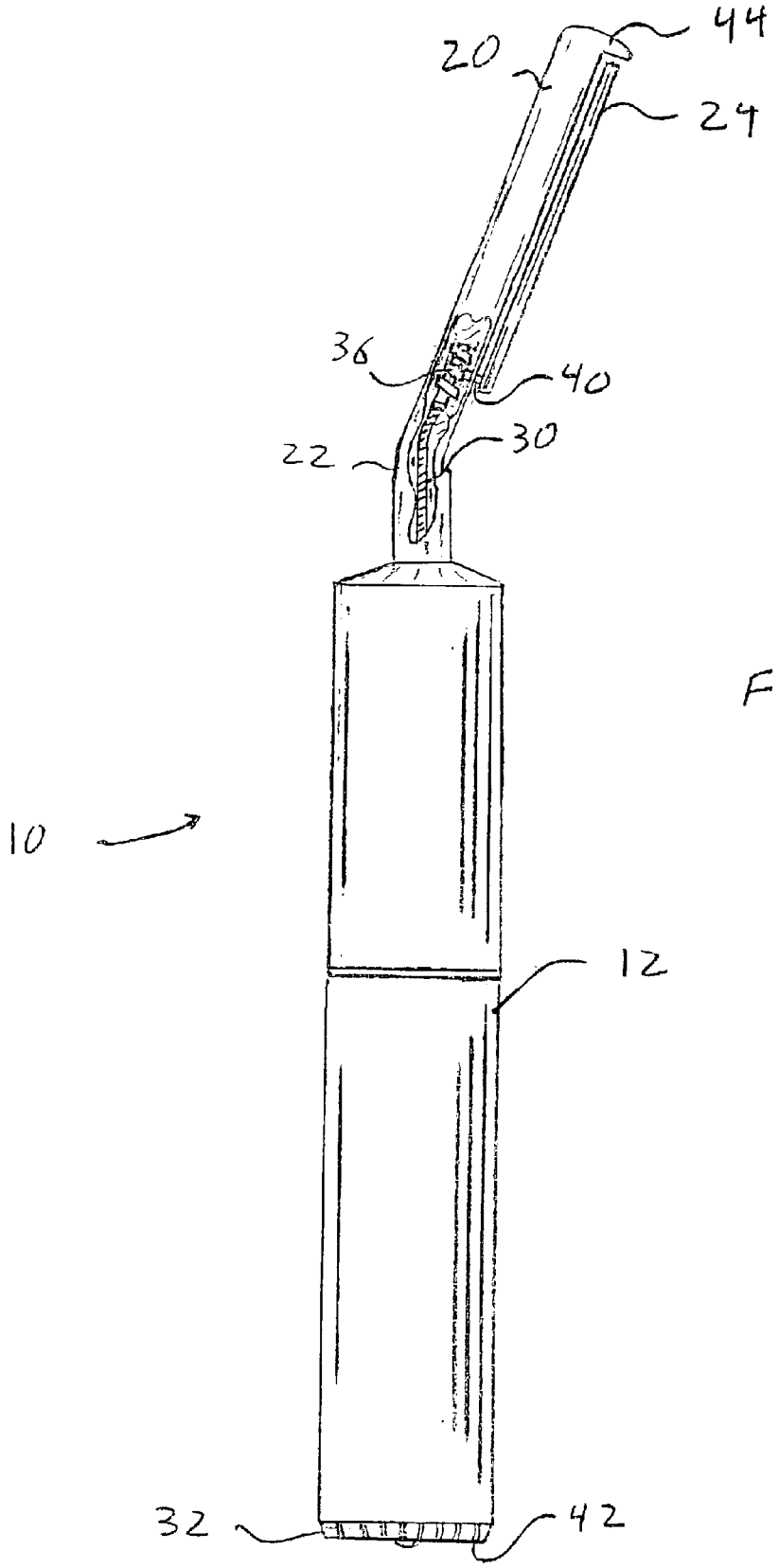
FIG. 3 is a side elevation view of a toothbrush of the present invention, also partially broken away, and with the bed and bristles removed for clarity.

One such simple gearing arrangement is illustrated in FIGS. 2 and 3. Shaft 30 is illustrated as a flexible shaft capable of transmitting rotatory motion through curves, as is known in the art. Shaft 30 is connected at a first, lower, end to knob 32 and at a second, upper, end to a worm gear 36. Worm gear 36 further engages a spur gear 38 which is connected to track 24, shown in phantom in FIG. 2, a partially broken away view of the mechanism as seen from the back or non-bristle side of the brush, via an axle or short shaft 40. It will be appreciated from an examination of FIG. 2 that a clockwise rotation of knob 32 as seen from the bottom of brush will result in worm gear urging spur gear 38 in a counter-clockwise direction as seen from the rear view of FIG. 2, or clockwise as seen from the front of the toothbrush. In order to facilitate gripping and turning of knob 32 by a user, the knob is provided with knurls or indentations 42.

It will be appreciated by those skilled in the art that other arrangements of gearing will be possible to a achieve the objective of translating rotatory motion of the knob to an appropriate rotation of the track. By use of a second spur gear for example (not shown), a rotatory motion of a worm gear attached to shaft 30 could be translated to axle 40 without the requirement of a flexible shaft. However, this arrangement would require additional gears relative to the illustrated embodiment.

Worm gear 36 may also be seen in partially broken away side elevation FIG. 3, with the spur gear omitted for clarity. Short shaft or axle 40 may however been seen more clearly penetrating the casing of toothbrush head 20 to join the spur gear to track 24. A projecting lip 44 or tip 44 or stop 44 on head 20 may also be seen in this view, whose function will become apparent below.

It will be appreciated that alternative sources of rotation, or rotators, may be situated at a lower end of hollow handle 12, other than a manually actuated knob. For example a small electric motor provided with a reversing switch (not shown) may be employed to rotate shaft 30, and hence track 24 in a manner similar to manual operation. The mechanical advantage provided by worm gear 36 and spur gear 38 will allow a motor with modest torque to accomplish this function.

It is also contemplated by the present invention that in an alternative embodiment not drawn, the rotator or knob 32 is located other than at the first end of shaft 30. For example, knob 32 may be located in the middle of handle 12 in any convenient manner accessible to the user and fitted on to shaft 30 so that rotating knob 32 turns shaft 30. In case knob 32 is in the middle of handle 12, to secure the part of the handle 12 below knob 32 to the rest of the device, there would be added a bridge of plastic (or of whatever the material the handle 12 is made of) or any other well known suitable means connecting the part of the handle above the knob with the part of the handle below the knob. With respect to this alternative embodiment, shaft 30 need not extend beyond rotator/knob 32. Furthermore, since knob 32 may not be at the first end of shaft 30, it is useful to describe the second end of shaft 30 as the end that is nearer to applicator section 18 than the first end of shaft 30.

Figures 4A, 4B, 4C, 4D, 4E:
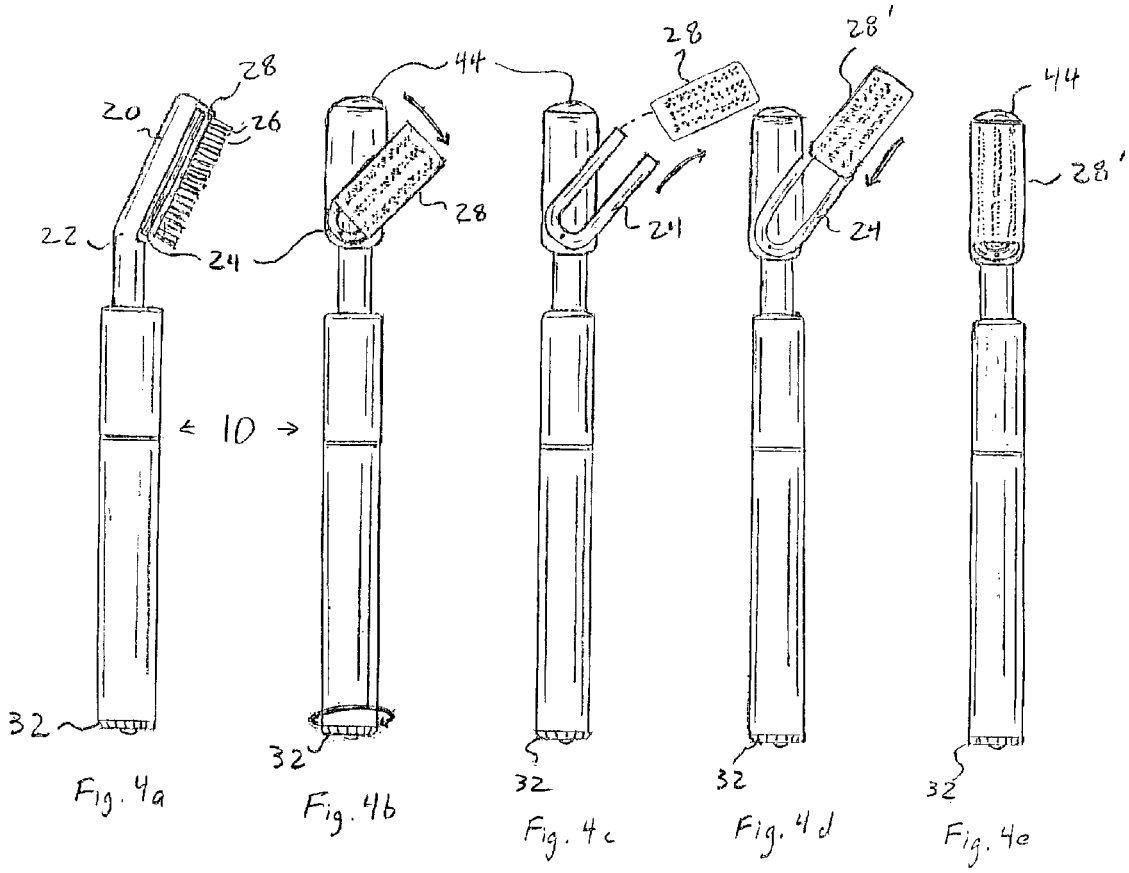
FIG. 4*a* is a side elevation view of the present invention showing a bristle bed mounted on the toothbrush handle.
FIG. 4*b* is a front elevation view of the present invention showing the track rotated out of the longitudinal axis of the handle.
FIG. 4*c* is a front elevation view of the present invention showing the step of removing a used bristle bed from the handle of the present invention.
FIG. 4*d* is a front elevation view of the present invention showing the step of inserting a new bristle bed onto the track.
FIG. 4*e* is a front elevation view of the present invention showing the track rotated back into an axis of the handle with the new bristle bed thereby in a position ready for use.

A method for interchanging bristle beds on a toothbrush 10 constructed in accordance with the invention is shown generally in FIGS. 4*a*–4*e*. FIG. 4*a* is a side elevation generally showing a toothbrush with a bristle bed in place, corresponding with FIG. 1. In FIG. 4*b* a rotation of knob 32 by a user is generally indicated by a bold circular arrow (not separately designated) in a vicinity of the knob, the rotation being in a clockwise direction as seen from a bottom of the toothbrush (which can be partially seen in the perspective view of FIG. 1). Accompanying this rotation, as will have been understood by examination of details in FIG. 2 and FIG. 3 showing the mechanism, will be a clockwise rotation of track 24 with attached bristle bed 28 rotation as seen from the front of the brush, as shown in FIG. 4*b*. The rotation of track 24 is generally indicated by a bold arcuate arrow (not separately designated) shown in a vicinity of the bristle bed.

It will also be understood from FIG. 4*b* that upon rotation of the track 24 the bristle bed 28 is freed from the locking effect of lip 44, and is therefore free to be slid off the track 24, as shown in FIG. 4*c*. In FIG. 4*d* a new bristle bed 28' is similarly shown being mounted on the track, and, following a reverse, counterclockwise rotation (not shown) of knob 32 by the user, reversing the effects of disassembly, the bed 28' is locked into place by interference with lip 44, thus preventing unintentional disengagement and readying the brush for renewed use, as shown in FIG. 4*d*.

Further variation or embellishments of the basic method will be readily understood, and are not specially illustrated. For example, it will be apparent that new bristle head 28' may be enclosed in an individual flexible sanitary package (not shown), similar to the familiar adhesive bandage strip, which may be torn open at time of use. Through tearing off one end of such a package and grasping the bed through the package walls, bristle bed 28' may be urged upon track 24 without fingers contacting the new bristles. Similarly, bristle beds may be packaged in multiple units, as in a box, in such a way that the track can be induced to engage an available bristle bed by manipulation of the box and brush, without necessity of fingers contacting the fresh bristles. In terms of removal of the old bed, it will be understood that in an open position, as shown in FIG. 4*c* an old bristle bed may be removed and projected into a waste receptacle by a flicking or whip like movement of the brush without the user contacting the soiled bristles.

It is thus apparent that the invention allows a replacement of a soiled or worn bristle bed by a new bristle bed without cross contamination of the new bristles by the old, or a necessity of user contact with either the old soiled bristles or the new sanitary bristles. The invention is thereby ideal for rendering a routine hygienic replacement of toothbrush bristles both practical and enjoyable, and unlike anything available in the prior art. The invention represents a method and device for the routine hygienic replacement of toothbrush bristles for the elimination of bacteria which is both easy, convenient, fun, and encourages frequent replacement.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A toothbrush, comprising a hollow handle, an applicator section, including a head and a neck, the head including a track that is pivotally mounted to a lower portion of the head, bristles sitting on a bed, the bed slidably engageable to said track, a shaft having a first end and a second end, the second end being nearer to the applicator section than the first end, the shaft running through the hollow handle and the neck of the applicator longitudinally, the shaft having a knob extending out of the handle so as to be accessible to a user, the second end of the shaft having gearing so that turning the knob rotates the track out of the longitudinal axis of the head to an open position, wherein in the open position the bed and bristles can be slidably removed from the track and replaced with a new bed and bristles and wherein when the track is aligned with the longitudinal axis of the head, the bed riding on the track locks into a tip of the head.

2. The toothbrush of claim 1, wherein said track is generally U-shaped.

3. The toothbrush of claim 1, wherein the head is bent at an angle with respect to the handle in order to facilitate a comfortable brushing position for a user.

4. The toothbrush of claim 1, wherein the gearing includes a worm gear and a spur gear.

5. The toothbrush of claim 4, wherein the spur gear is connected to the track via an axle, and the worm gear is connected to the knob via the shaft.

6. The toothbrush of claim 5, wherein the shaft is a flexible shaft.

7. The toothbrush of claim 1, wherein the knob has a knurled surface.

8. A toothbrush, comprising a hollow handle, an applicator section, including a head and a neck, the head including a track that is pivotally mounted to a lower portion of the head, bristles sitting on a bed, the bed slidably engageable to said track, a shaft running through the hollow handle and the neck of the applicator longitudinally, the shaft having a knob at a first end, said knob extending from a bottom of the handle, a second end of the shaft having gearing so that turning the knob rotates the track out of the longitudinal axis of the head to an open position, wherein in the open position the bed and bristles can be slidably removed from the track and replaced with a new bed and bristles and wherein when the track is aligned with the longitudinal axis of the head, the bed riding on the track locks into a tip of the head.

9. The toothbrush of claim 8, wherein said track is generally U-shaped.

10. The toothbrush of claim 8, wherein the head is bent at an angle with respect to the handle in order to facilitate a comfortable brushing position for a user.

11. The toothbrush of claim 8, wherein the gearing includes a worm gear and a spur gear.

12. The toothbrush of claim 11, wherein the spur gear is connected to the track via an axle, and the worm gear is connected to the knob via the shaft.

13. The toothbrush of claim 12, wherein the shaft is a flexible shaft.

14. The toothbrush of claim 8, wherein the knob has a knurled surface.

15. A toothbrush, comprising a hollow handle, an applicator section, including a head and a neck, the head including a track that is pivotally mounted to a lower portion of the head, bristles sitting on a bed, the bed slidably engageable to said track a shaft running through the hollow handle and the neck of the applicator longitudinally, the shaft having a rotator at a first end, a portion of said rotator extending from a bottom of the handle, a second end of the shaft having gearing so that operating the rotator turns the track off the longitudinal axis of the head to an open position, wherein in the open position the bed and bristles can be slidably removed from the track and replaced with a new bed and bristles and wherein when the track is aligned with the longitudinal axis of the head, the bed riding on the track locks into a tip of the head.

16. The toothbrush of claim 15, wherein the rotator comprises an electric motor.

17. A method for interchanging bristle beds on a toothbrush, including the steps of:

(a) taking in hand the toothbrush, said toothbrush including a handle, a head, a rotatable track having substantially parallel and rigid rails being pivotably mounted to the head at one end of the track, and a knob being connected to the track via a shaft and gearing so that a rotation of the knob effects a rotation of the track, said track having thereon a used bristle bed adapted to slidably engage the substantially parallel and rigid rails of the track;

(b) rotating the knob so as to rotate the track out of a longitudinal axis of the head into an open position, (c) sliding said bristle bed off the track for disposal, (d) taking in hand a new bristle bed and slidingly mounting the new bristle bed on the track, and (e) rotating the knob so as to rotate the track into a longitudinal axis of the head into a closed position, thereby causing a tip located on the head to trap and lock the new bristle bed.

18. The method of claim 17, wherein step "(d)" is replaced by a step of tearing open an individual sanitary enclosure containing a new bristle bed and sliding the new bristle bed onto the track while holding the sanitary enclosure so as to avoid touching the new bristle bed.

19. The method of claim 17, wherein step "(d)" is replaced by a step of opening a container containing a plurality of new bristle beds and inserting the track into the container while holding the container so that the track engages a new bristle bed thereby avoiding touching the new bristle bed.

20. The method of claim 17, wherein step "(c)" is replaced by a step of forcefully snapping the toothbrush by hand when the track is in the open position, so that the used bristle bed is propelled off the track in a whipping motion, without a user directly touching the used bristle bed.

* * * * *